US009393469B2

(12) United States Patent
Shimahara

(10) Patent No.: US 9,393,469 B2
(45) Date of Patent: Jul. 19, 2016

(54) IRON TYPE GOLF CLUB HEAD

(71) Applicant: DUNLOP SPORTS CO. LTD., Kobe-shi, Hyogo (JP)

(72) Inventor: Yuki Shimahara, Kobe (JP)

(73) Assignee: DUNLOP SPORTS CO. LTD., Kobe-shi (JP)

( * ) Notice: Subject to any disclaimer, the term of this patent is extended or adjusted under 35 U.S.C. 154(b) by 0 days.

(21) Appl. No.: 14/646,460

(22) PCT Filed: Nov. 22, 2013

(86) PCT No.: PCT/JP2013/081482

§ 371 (c)(1),
(2) Date: May 21, 2015

(87) PCT Pub. No.: WO2014/087852

PCT Pub. Date: Jun. 12, 2014

(65) Prior Publication Data

US 2015/0290502 A1 Oct. 15, 2015

(30) Foreign Application Priority Data

Dec. 3, 2012 (JP) ..... 2012-264664

(51) Int. Cl.
*A63B 53/04* (2015.01)

(52) U.S. Cl.
CPC ..... *A63B 53/047* (2013.01); *A63B 2053/0408* (2013.01); *A63B 2053/0479* (2013.01)

(58) Field of Classification Search
CPC ..... A63B 53/04
See application file for complete search history.

(56) References Cited

U.S. PATENT DOCUMENTS 5,282,625 A 2/1994 Schmidt et al.
5,472,203 A * 12/1995 Schmidt ..... A63B 53/04 473/350
6,702,693 B2 * 3/2004 Bamber ..... A63B 53/04 473/349
6,918,840 B2 * 7/2005 Stites ..... A63B 53/04 473/291

FOREIGN PATENT DOCUMENTS

JP 6-86842 A 3/1994
JP 7-299165 A 11/1995

(Continued)

OTHER PUBLICATIONS

International Search Report, issued in PCT/JP2013/081482, dated Feb. 25, 2014.

*Primary Examiner* — Michael Dennis
(74) *Attorney, Agent, or Firm* — Birch, Stewart, Kolasch & Birch, LLP

(57) ABSTRACT

Provided is an iron type golf club head having an undercut cavity. The iron type golf club head comprises a face portion (2) for hitting a ball; a peripheral edge (2*e*) of the face portion (2) is provided with a flange portion (7) protruding backward of the head; a rear surface (5) of the face portion (2) is provided with a cavity (C) surrounded by the flange portion (7). The flange portion (7) includes a first flange part (8). The first flange part (8) is provided in its inner surface (8*i*) side facing to the cavity (C) with a first concave part (10) dented toward the outside of the head so as to form an undercut cavity (c2) extending along the peripheral edge (2*e*). The cross-section of the first concave part (10) comprises a front wall surface (11) positioned frontward of the head, a rear wall surface (12) positioned backward of the head, and a bottom surface (13) smoothly connecting therebetween, and the cross-section is tapered toward the bottom surface (13). The angle (θ1) formed between the front wall surface (11) and the rear wall surface (12) is not less than 10 degrees and less than 30 degrees, and the bottom surface (13) is formed of a circular arc having a radius (R1) of curvature of not less than 1 mm and less than 2 mm.

12 Claims, 6 Drawing Sheets

(56) References Cited

FOREIGN PATENT DOCUMENTS

| | | | |
|---|---|---|---|
| JP | 10-234897 | A | 9/1998 |
| JP | 11-178960 | A | 7/1999 |
| JP | 2000-288128 | A | 10/2000 |
| JP | 2001-190720 | A | 7/2001 |
| JP | 2005-193069 | A | 7/2005 |
| JP | 2007-61369 | A | 3/2007 |

* cited by examiner (a)

(b)

IRON TYPE GOLF CLUB HEAD

TECHNICAL FIELD

The present invention relates to an iron-type golf club head having an undercut cavity.

BACKGROUND ART

The following Patent Documents 1 to 5 disclose iron-type golf club heads. Each of these iron type golf club heads has a face portion with a front surface for hitting a ball. The face portion is provided in its peripheral edge with a flange portion protruding backwardly of the head. The flange portion is formed annularly in a rear surface of the face portion so as to define a cavity (cavity back iron). Since a part of the face portion corresponding to the cavity has a small thickness, the face portion is easy to be bent and produces high rebound performance.

The flange portion may be provided in its inner surface side facing to the cavity with a concave part dented toward the outside of the head. Such concave part forms a so-called undercut cavity. In such a golf club head, the region of the cavity is expanded toward the outside of the head, and a sweet area where the high rebound performance is produced is widened.

PRIOR ART DOCUMENTS

Patent Documents

Patent Document 1: Japanese Patent Application Publication No. 2001-190720

Patent Document 2: Japanese Patent Application Publication No. 2005-193069

Patent Document 3: Japanese Patent Application Publication No. 2000-288128

Patent Document 4: Japanese Patent Application Publication No. H10-234897

Patent Document 5: Japanese Patent Application Publication No. H11-178960

SUMMARY OF THE INVENTION

Problem to be Sold by the Invention

In the meantime, there is a problem that the mass of a head increases with increase in the thickness of a flange portion. Especially, if a flange portion having a large thickness in an upper side of the head is formed, the golf club head has an undesirably high center of gravity of the head. Therefore, it is desirable that the thickness of the flange portion, in particular, that in an upper side of the head is made smaller.

In the case of a head whose flange portion has a small thickness, however, it is difficult to form an undercut cavity. For example, if the undercut cavity is manufactured through a lost-wax casting process, molding sand does not fully fill in the inside of the undercut cavity of the wax model. Because of this, there was a problem that it was difficult to form the mold with accuracy.

In view of the circumstances as described above, the present invention was devised, and the primary objective is to provide an iron type golf club head in which it is possible to accurately form an undercut cavity in a flange portion having a small thickness.

Means of Solving the Problems

The present invention is of an iron type golf club head having a face portion with a front surface for hitting a ball, and characterized in that the face portion is provided in its peripheral edge with a flange portion protruding backwardly of the head, a rear surface of the face portion is provided with a cavity surrounded by the flange portion, the flange portion includes a first flange part, the first flange part is provided in its inner surface side facing to the cavity with a first concave part dented toward the outside of the head so as to form an undercut cavity extending along the peripheral edge, a cross-section of the first concave part comprises a front wall surface positioned frontward of the head, a rear wall surface positioned backward of the head, and a bottom surface smoothly connecting therebetween, and the cross-section is tapered toward the bottom surface, an angle formed between the front wall surface and the rear wall surface is not less than 10 degrees and less than 30 degrees, and the bottom surface is formed of a circular arc having a radius of curvature of not less than 1 mm and less than 2 mm.

In the iron type golf club head according to the present invention, the cross-section of the first concave part may have a maximum width of from 2.0 mm to 4.0 mm and a maximum depth of from 1.0 mm to 2.0 mm.

In the iron type golf club head according to the present invention, the first flange part can be formed at least partially in an upper side of the head.

In the iron type golf club head according to the present invention, the first flange part may have a thickness of 5.5 mm to 8.0 mm.

The iron type golf club head according to the present invention can be configured such that the flange portion includes a second flange part, the second flange part is provided in its inner surface side facing the cavity with a second concave part dented toward the outside of the head so as to form an undercut cavity extending along the peripheral edge, the cross-section of the second concave part at the deepest part includes a front wall surface positioned frontward of the head, a rear wall surface positioned backward of the head, and a bottom surface connecting therebetween, and the cross-section is tapered toward the bottom surface, an angle formed between the front wall surface and the rear wall surface of the second concave part is not less than 10 degrees and not more than 30 degrees, and the bottom surface of the second concave part has a width of not less than 2 mm.

In the iron type golf club head according to the present invention, the second flange part can be formed at least partially in a bottom side of the head.

Effect of the Invention

The iron type golf club head according to the present invention is provided in the peripheral edge of the face portion with the flange portion protruding backward of the head. The rear surface of the face portion is provided with the cavity surrounded by the flange portion. The flange portion includes the first flange part. The first flange part is provided in the inner surface side facing to the cavity with the first concave part dented toward the outside of the head so as to form the undercut cavity extending along the peripheral edge. Such undercut cavity provides the head having high rebound performance.

The first concave part comprises, in the cross-section thereof, the front wall surface positioned frontward of the head, the rear wall surface positioned backward of the head, and the bottom surface smoothly connecting therebetween, and is tapered toward the bottom surface. The angle between the front wall surface and the rear wall surface is not less than 10 degrees and less than 30 degrees. Further, the bottom surface is formed of a circular arc having radius of curvature of not less than 1 mm. In the first concave part having such cross-section, when the head is manufactured through a lost-wax process, molding sand smoothly comes in to the bottom surface of the first concave part of the wax model, and it becomes possible to form the first concave part with accuracy. Further, since the radius of curvature of the circular arc of the bottom surface of the first concave part is set to less than 2 mm, it becomes possible to form the first concave part having a small width. Thereby, it is possible to reduce the thickness of the flange portion, and the head having a small mass may be provided. Moreover, it is possible to lower the center of gravity of the head while saving a redundant mass. Therefore, the head according to the present invention can be easily provided with high rebound performance and a low center of gravity of the head.

MODE FOR CARRYING OUT THE INVENTION

Hereinafter, an embodiment of the present invention will be described with reference to the drawings.

Figure 1:
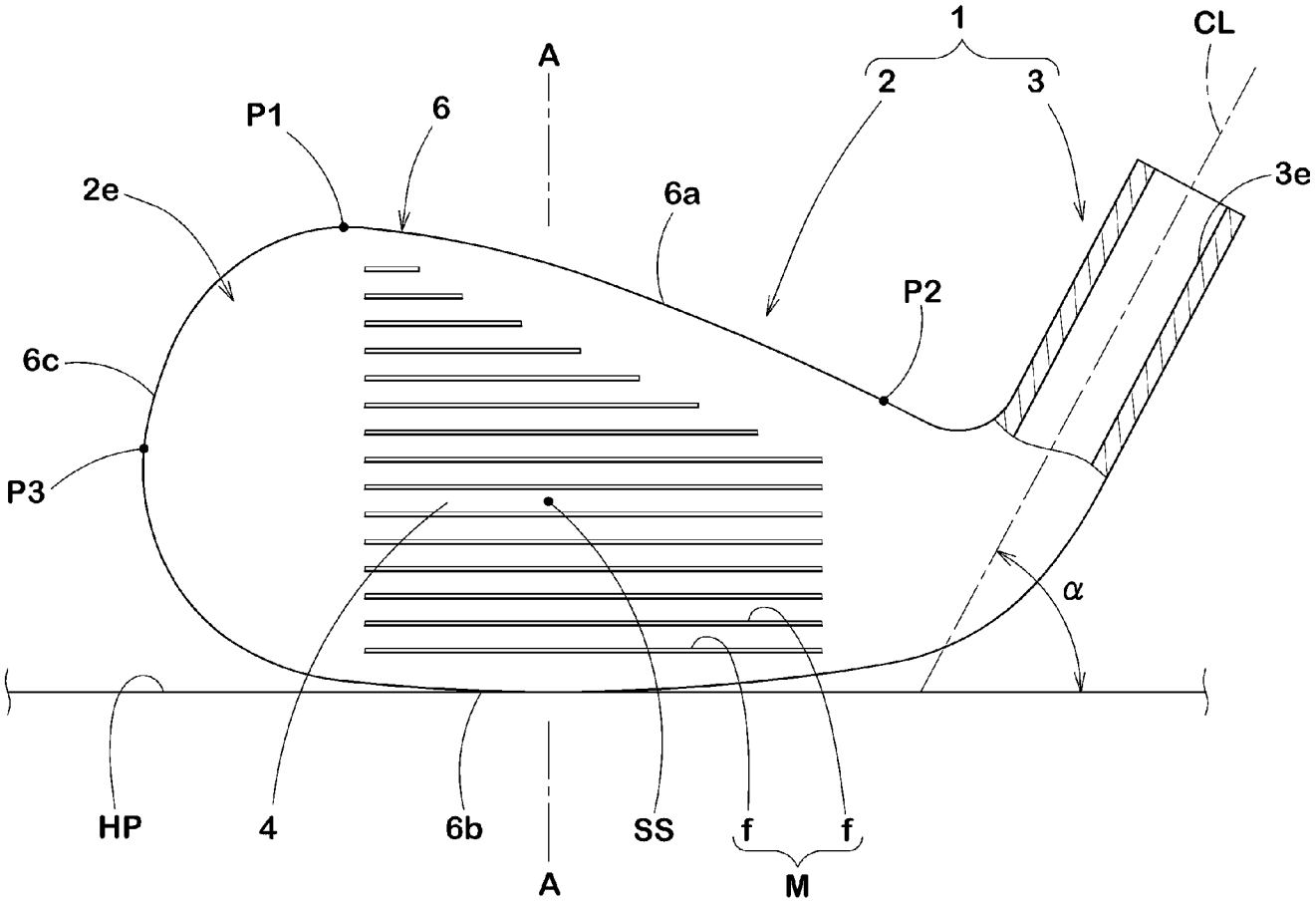
FIG. 1 a front view of an iron type golf club head as an embodiment of the present invention under its standard state.
Figure 2:
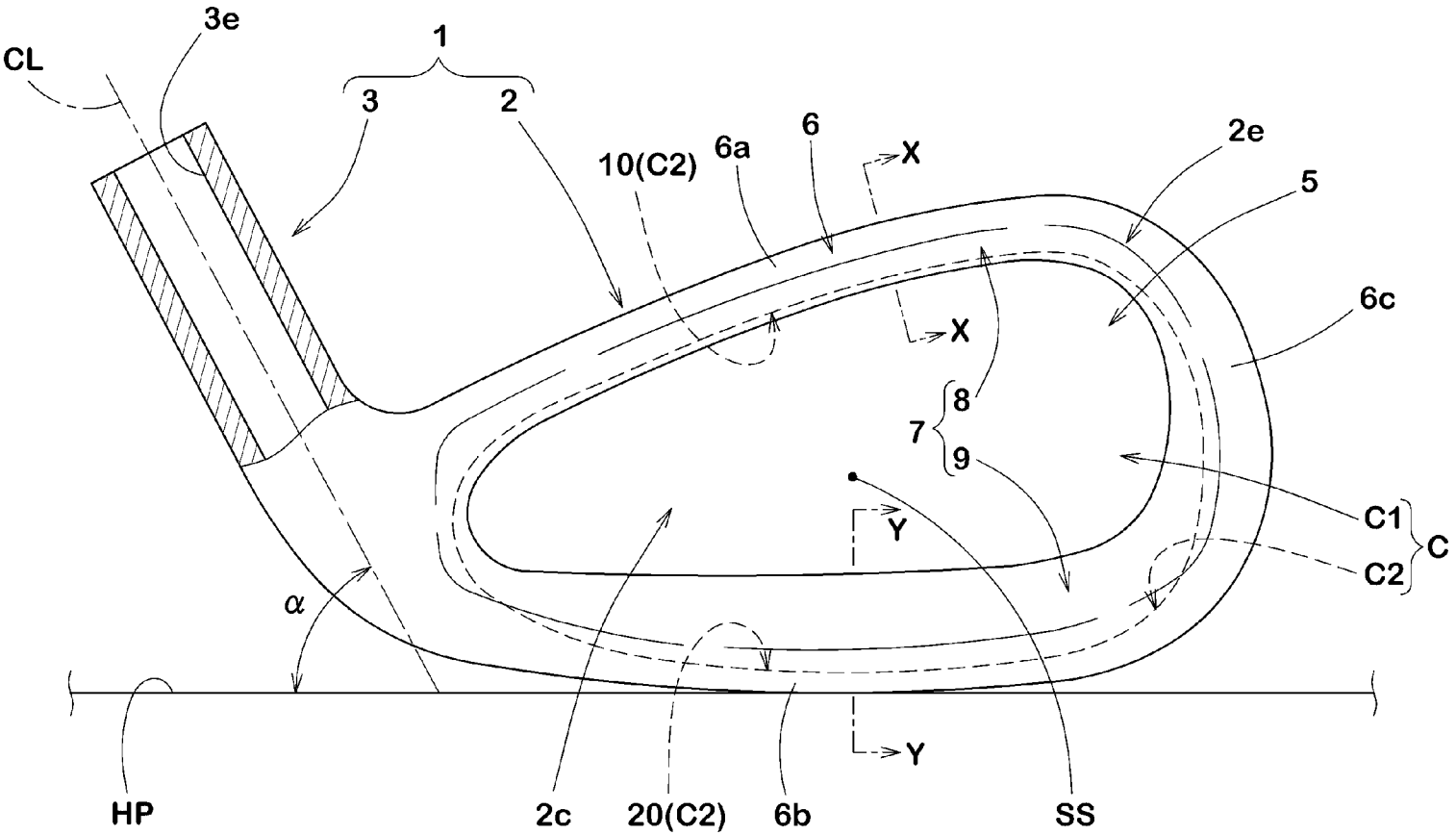
FIG. 2 a rear view for FIG. 1.

FIG. 1 is a front view showing an iron type golf club head (hereinafter, simply referred to as a "head") 1 of the present embodiment in a standard state, and FIG. 2 is the rear view thereof.

Figure 3:
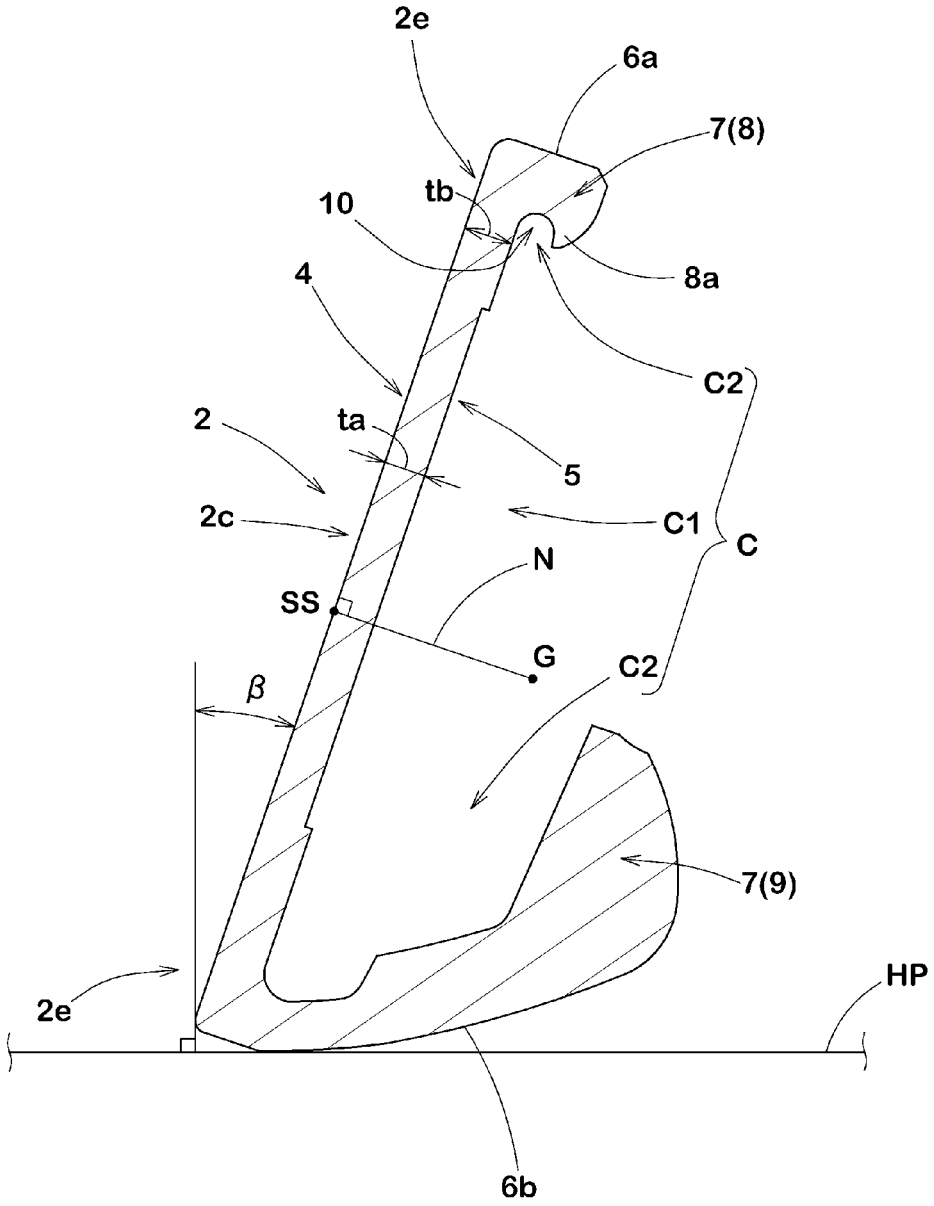
FIG. 3 an enlarged cross-sectional view taken along A-A line of FIG. 1.

In this description, the standard state of the head 1 is a state that the head 1 is set on a horizontal plane HP at a specified loft angle beta (the loft angle beta is shown in FIG. 3) so that its shaft center line CL is disposed in an arbitrary vertical plane and inclined at a specified lie angle alpha. In this description, unless otherwise noted, the head 1 is under the standard state.

The lie angle alpha and the loft angle beta of the head 1 are not particularly limited. Typically, the lie angle is preferably in a range of from 50 to 70 degrees, and the loft angle beta is preferably in a range of from 15 to 70 degrees.

The mass of the head 1 is not particularly limited. Typically, the mass of the head 1 is preferably set in a range of from 200 g to 300 g.

As shown in FIG. 1, the head 1 comprises a face portion 2, and a hosel portion 3 provided on the heel-side thereof. The head 1 of the present embodiment is made of a metallic material and manufactured through a lost-wax process.

The hosel portion 3 is formed in a substantially cylindrical form having a shaft inserting hole 3*e* into which a shaft (not shown) is inserted.

The shaft center line of the shaft inserting hole 3*e* corresponds to the above-mentioned shaft center line CL.

The face portion 2 comprises a front surface 4 for hitting a ball, a rear surface 5 on the opposite side thereof, an outer peripheral surface 6 between the front surface 4 and the rear surface 5.

The front surface 4 of the face portion 2 is, for example, formed of a substantially single flat surface. The front surface 4 may be provided with an impact area marking M. In the present embodiment, as the impact area marking M, there are provided a plurality of face lines (f) extending in a toe-heel direction. As the impact area marking M, a punch mark may be provided.

The outer peripheral surface 6 of the face portion 2 comprises a top surface 6*a* on the upper side of the head, a sole surface 6*b* on the bottom side of the head, and a toe surface 6*c* connecting therebetween on the toe-side.

In the front surface 4 of the face portion 2, for example, the top surface 6*a* extends from a highest point P1 in a toe-side to a lowest point P2 in a heel-side.

The sole surface 6*b* extends in a region below the top surface 6*a*.

The toe surface 6*c* includes a most toe-side point P3 and extends between the top surface 6*a* and the sole surface 6*b*.

In FIG. 3, the section A-A of FIG. 1 is shown. As shown in FIG. 2 and FIG. 3, the peripheral edge 2*e* of the face portion 2 is provided with a flange portion 7 protruding backward of the head.

The peripheral edge 2*e* of the face portion 2 is a part of the face portion 2 on the outer peripheral surface 6 side. on the other hand, a central part 2*c* of the face portion 2 is defined as a region including a sweet spot ss of the head 1.

The sweet spot ss is, as shown in FIG. 3, an intersection point of a normal line N, which is drawn from the center G of gravity of the head to the front surface 4, with the front surface 4.

Since the central part 2*c* of the face portion 2 is expected to have frequent impacts with a ball, it is preferable that the central part 2*c* has a thickness (ta) of 2.0 to 3.0 mm, for example.

The flange portion 7 in the present embodiment is formed annularly so as to surround the central part 2*c* of the face portion 2. owing to such flange portion 7, a cavity c surrounded by the flange portion 7 is formed in the rear surface 5 of the face portion 2.

The cavity c provides a small thickness to the face portion 2. Therefore, when this part hits a golf ball, the face portion 2 is largely bent, and a long carry distance can be obtained. Further, the flange portion 7 distributes more mass to the peripheral edge 2*e* of the face portion 2.

Thereby, the head 1 of the present embodiment can have a large moment of inertia Ig about a horizontal axis passing the center G of gravity of the head (hereinafter, such moment of inertia may be referred as the "up-down moment of inertia") so as to obtain stable carry distances, for example.

In the present embodiment, the flange portion 7 comprises a first flange part 8 extending along the top surface 6*a* and a second flange part 9 extending along the sole surface 6*b*.

Figure 4:
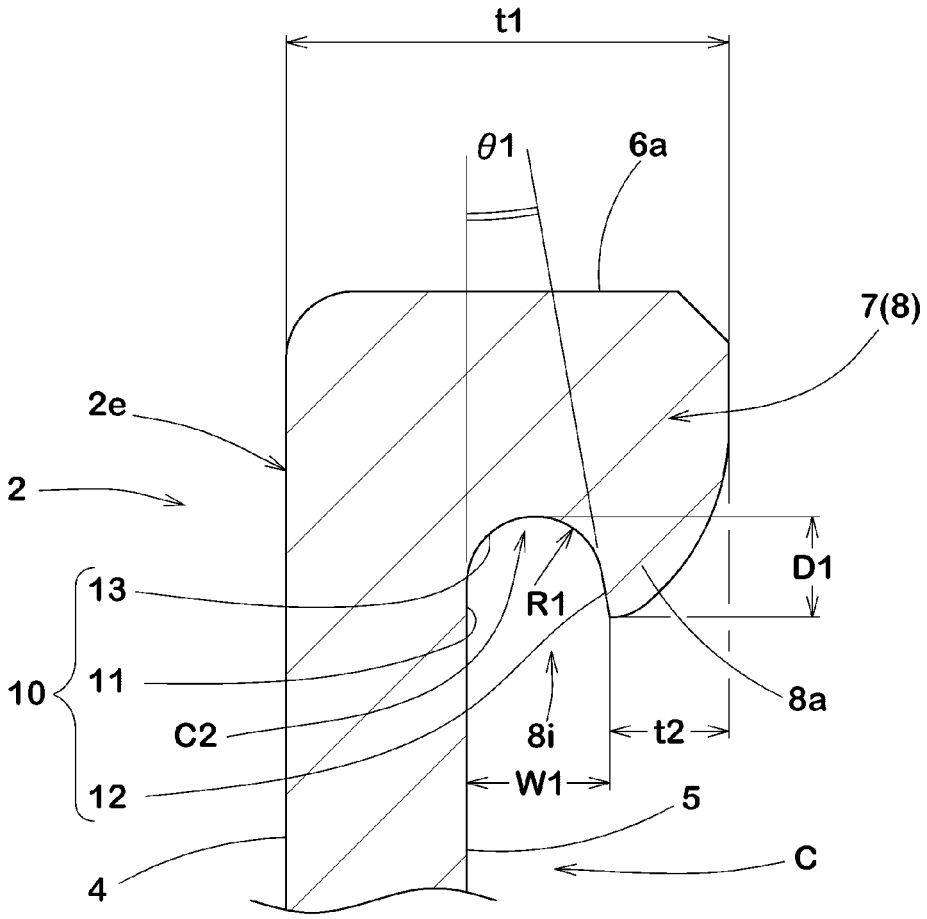
FIG. 4 an enlarged cross-sectional view taken along x-x line of FIG. 2.

In FIG. 4, the section x-x of FIG. 2 is shown enlargedly. The first flange part 8 is provided in its inner surface 8*i* side facing the cavity c with a first concave part 10.

The first concave part 10 dents toward the outside of the head and extends along the peripheral edge 2*e* so as to form an undercut cavity c2 as shown in FIG. 2 and FIG. 4. The first concave part 10 is in a groove-like dent. If the head 1 is viewed from behind in a direction perpendicular to the front surface 4, the undercut cavity c2 is covered with a cover part 8*a* of the first flange part 8 and invisible.

Therefore, in the head 1 of the present embodiment, the cavity c includes an open cavity c1 not covered with the cover part 8*a* and the undercut cavity c2.

In the face portion 2 provided with the undercut cavity c2, the region which bends when hitting a ball is further expanded. Thus, the head 1 of the present embodiment produces high rebound performance. Especially, as the first concave part 10 reduces the mass on the upper side of the head, the head can be provided with the lowered center G of gravity.

As shown in FIG. 4, the cross-section of the first concave part 10 comprises a front wall surface 11 positioned frontward of the head, a rear wall surface 12 positioned backward of the head and a bottom surface 13 smoothly connecting therebetween, and is tapered toward the bottom surface 13.

The angle θ1 formed between the rear wall surface 12 and the front wall surface 11 of the first concave part 10 is in a range of from not less than 10 degrees to less than 30 degrees. Moreover, a radius R1 of curvature of the bottom surface 13 of the first concave part 10 is in a range of from not less than 1 mm to less than 2 mm.

The first concave part 10 having the above-mentioned cross-section is accurately formed even if the head is manufactured through a lost-wax process.

Figure 6:
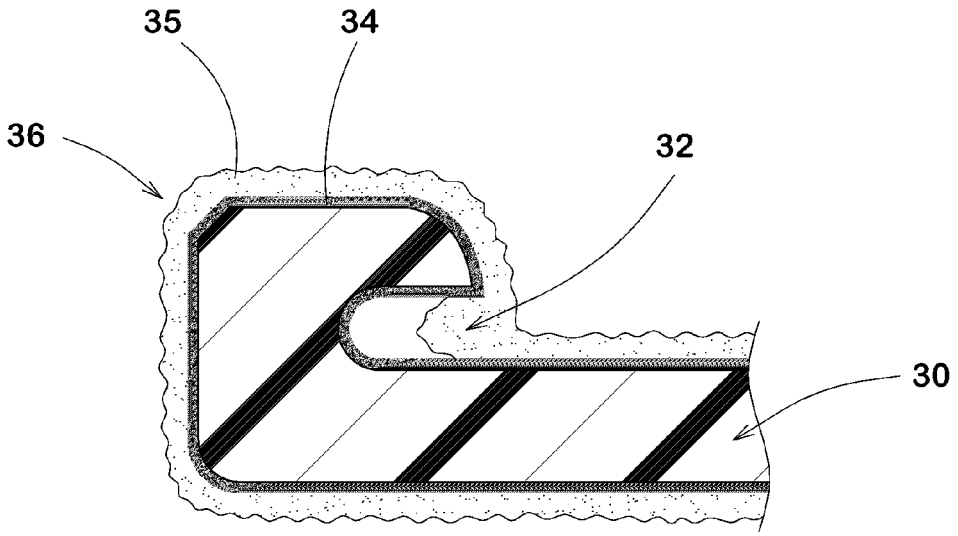
FIG. 6 a partial cross-sectional view for explaining a mold for use in a lost-wax process.
Figure 6:
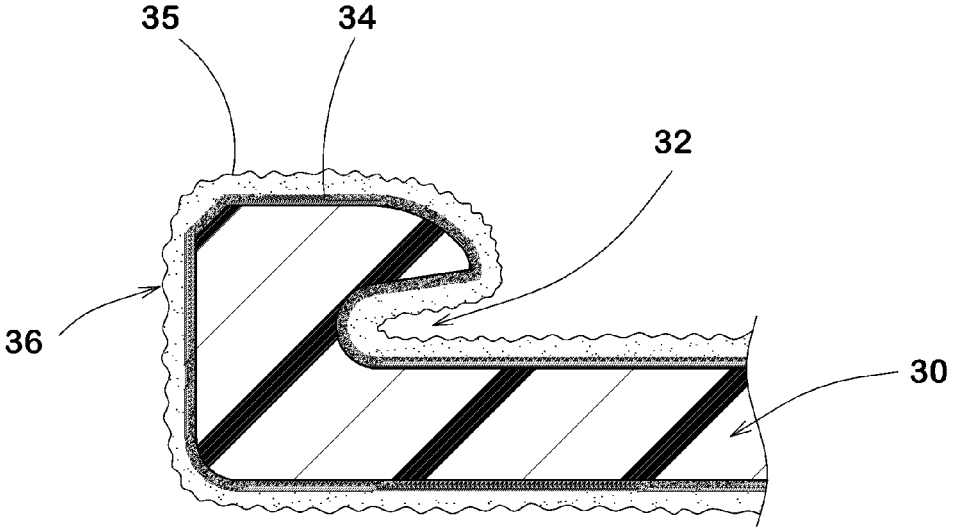

In the lost-wax process, as shown in FIGS. 6 (*a*) and (*b*), a wax model 30 having the same form as the head 1 is formed. So, the wax model 30 has the first concave part 32.

On the surface of the wax model 30 after immersed in liquid slurry 34, molding sand 35 from which a mold 36 is made mostly is attached and hardened. Then, the wax model is melted and took out, and the mold 36 is formed.

As shown in FIG. 6 (*a*), if the cross-sectional shape of the first concave part 32 is not desirable, the molding sand 35 is resisted and cannot smoothly come in to the bottom of the first concave part 32 of the wax model 30.

On the other hand, as shown in FIG. 6 (*b*), if the first concave part 32 has the improved cross-section as in the present invention, the molding sand 35 can smoothly come in to the bottom of the first concave part 32 of the wax model 30.

Therefore, the mold 36 having a molding surface substantially same as the outer surface of the wax model 30 is formed accurately; consequently, the head 1 can be molded with accuracy.

Since the radius R1 of curvature of the circular arc of the bottom surface 13 of the first concave part 10 is less than 2 mm, the first concave part 10 (eventually the undercut cavity c2) having a small width w1 is formed. As a result, the first flange part 8 having a small thickness t1 is provided, and the mass of the head, especially the mass on the upper side of the head, is reduced. As a result, the center G of gravity of the head can be lowered, and a surplus mass usable in mass distribution design can be obtained. Therefore, the head of the present embodiment can be provided with high rebound performance and the lowered center of gravity of the head.

If the angle θ1 between the rear wall surface 12 and the front wall surface 11 of the first concave part 10 is less than 10 degrees, the molding sand cannot adequately come in to the bottom surface of the first concave part of the wax model. Thus, the undercut cavity c2 having a small width cannot be accurately formed. on the other hand, if the angle θ1 is not less than 30 degrees, the thickness t1 of the first flange part 8 becomes large. Therefore, the mass on the upper side of the head becomes large, and the lowered center of gravity of the head cannot be achieved. Moreover, the first flange part 8 cannot achieve sharp and good appearance. Furthermore, if the thickness t1 of the first flange part 8 is large, the appearance configuration of the cover part 8*a* possibly deteriorates.

The angle θ1 is preferably not less than 15 degrees and not more than 25 degrees.

In order to derive such effect more effectively, the front wall surface 11 and the rear wall surface 12 are desirably formed in a linear fashion in the above-mentioned cross-section.

Preferably, the front wall surface 11 is smoothly continued into the rear surface of the central part 2*c* of the face portion 2. Thereby, it becomes easy for the molding sand to enter the first concave part of the wax model, and the undercut cavity c2 can be accurately formed.

The radius R1 of curvature of the bottom surface 13 of the first concave part 10 determines a width of an opening of the first concave part 10. Thus, if the radius R1 of curvature of the bottom surface 13 is less than 1 mm, the first concave part 10 (eventually the undercut cavity c2) is hard to be formed accurately through the lost-wax casting process.

If the radius R1 of curvature is not less than 2 mm, the width w1 of the first concave part 10 (eventually the undercut cavity c2) becomes increased, and accordingly, the thickness t1 of the first flange part 8 becomes increased. This possibly causes increase of the mass of the head and a high gravity center G of the head. Preferably, the radius R1 of curvature of the circular arc of the bottom surface 13 is not less than 1.2 mm and not more than 1.8 mm.

In order to enhance the advantages in the rebound performance and the head mass reduction, it is desirable that the cross-section of the first concave part 10 has a maximum width w1 of from 2.0 to 4.0 mm and a maximum depth D1 of from 1.0 mm to 2.0 mm. In the present embodiment, the width w1 of the first concave part 10 is, in FIG. 4, measured in the normal direction to the front surface 4. Similarly, in FIG. 4, the depth D1 of the first concave part 10 is measured parallel to the front surface 4.

In the first flange part 8, it is preferable that the thickness t1 is 5.5 to 8.0 mm.

If the thickness t1 of the first flange part 8 is less than 5.5 mm, there is a possibility that the strength of the first flange part 8 deteriorates. If the thickness t1 of the first flange part 8 is over 8.0 mm, there is a possibility that the mass of the head is increased, causing a high gravity center G of the head. Moreover, the first flange part 8 having sharp appearance cannot be obtained.

From these view points, the thickness t1 of the first flange part 8 is more preferably not less than 6.0 mm and not more than 7.5 mm.

In this specification, the thickness t1 of the first flange part 8 is a length measured perpendicular to the front surface 4 from the front surface 4 to the most rearward position of the first flange part 8 as shown in FIG. 4.

The length along the outer peripheral surface 6 of the first concave part 10 is preferably not less than 10% of the length of the top surface 6*a*.

Figure 5:
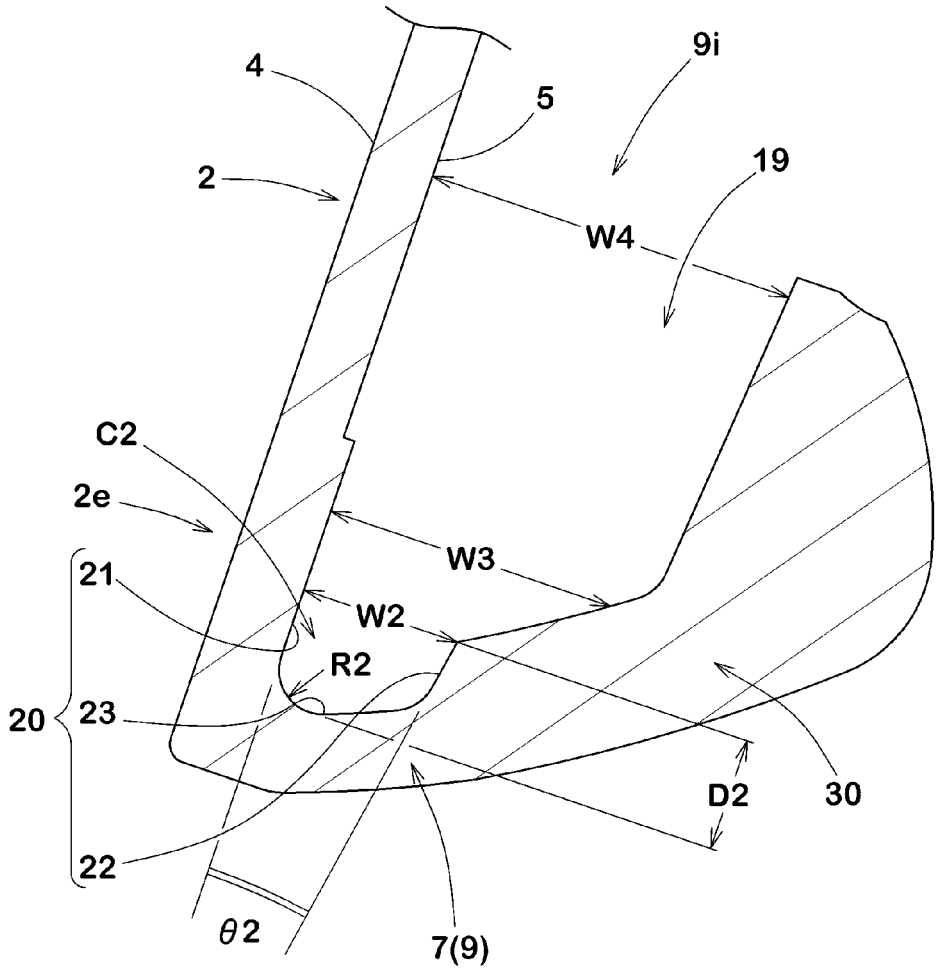
FIG. 5 an enlarged cross-sectional view taken along Y-Y line of FIG. 2.

In FIG. 5, the section Y-Y of FIG. 2 is shown. As shown in FIG. 5, the second flange part 9 is provided in its inner surface 9*i* side facing to the cavity c with a second concave part 19 dented toward the outside of the head.

As shown in FIG. 2, the second concave part 19 also extends along the peripheral edge 2*e* so as to form the undercut cavity c2. Similarly to the first concave part 10, the second concave part 19 is also a groove-like dent.

The second flange part 9 extends in the toe-heel direction along the sole surface 6*b*.

As shown in FIG. 3, in comparison with the first flange part 8, the second flange part 9 largely protrudes backward of the head in order to distribute more mass to a bottom side of the head. According to the enlarged second flange part 9, the second concave part 19 has a larger cross-sectional area than the first concave part 10. Thus, the mass of the second flange part 9 can be distributed to further lower and more rear position.

Generally, forming a second concave part 19 having a large cross-sectional area is comparatively easy.

However, if the width is gradually altered toward the deepest portion 20, like the widths w4, w3 and w2 in the second concave part 19 of the present embodiment, then accurately forming the deepest portion 20 is as difficult as forming the first concave part 10.

In the present embodiment, the cross-section of the deepest portion 20 of the second concave part 19 comprises a front wall surface 21 positioned frontward of the head, a rear wall surface 22 positioned backward of the head, and a bottom surface 23 smoothly connecting therebetween, and is tapered toward the bottom surface 23.

The angle θ2 formed between the rear wall surface 22 and the front wall surface 21 of the deepest portion 20 is set to be not less than 10 degrees and not more than 30 degrees.

The radius R2 of curvature of the bottom surface 23 of the deepest portion 20 is not less than 2 mm.

The deepest portion 20 of the second concave part 19 having the above-mentioned cross-sectional shape can be formed accurately through the lost-wax process for the same reason as the first concave part 10.

Preferably, in the deepest portion 20 of the second concave part 19, the front wall surface 21 and the rear wall surface 22 are formed in a linear fashion in the cross-section.

The head 1 of the present embodiment has the up-down moment of inertia Ig which is preferably not less than 550 g sq·cm, more preferably not less than 600 g sq·cm, and preferably not more than 1050 g sq·cm, more preferably not more than 1000 g sq·cm to suppress an increase of the mass of the head and to lessen variations of the carry distance, Taking a realizable range into consideration, the height of the center G of gravity of the head is preferably not less than 18 mm, more preferably not less than 18.5 mm, and is preferably not more than 21 mm, more preferably not more than 20.5 mm to achieve desirable back spin when hitting a ball.

While the embodiment of the present invention has been described in detail as above, the present invention is not limited to the specific embodiment described above, and the present invention can be carried out by modifying into various embodiments.

EXAMPLES

In order to confirm the effects of the present invention, iron type golf club heads based on specifications shown in Table 1 were tested. Each of the heads had the same configuration except for parameters shown in Table 1.

Main Common Specifications of Each Head Were as Follows.

Lie angle alpha: 61 degrees

Loft angle beta: 24 degrees

Material of head: stainless steel

Area of face: 36.0 sq·cm

Thickness (ta) of most thin part of face portion: 2.27 mm

Thickness (tb) of face portion in front wall surface part of first concave part: 2.30 mm Length along outer peripheral surface of first concave part/Length of top surface: 100%

Manufacturing method head: lost-wax casting process

Test Method Was As Follows.

<Height of Center of Gravity of Head>

The height of the center of gravity of the head, which is a vertical height measured in the standard state from the horizontal plane HP to the center of gravity of the head, was measured. In the results, the smaller value is better.

<Rebound Performance>

According to the "Procedure for Measuring the velocity Ratio of a club Head for conformance to Rule 4-1e, Revision 2 (Feb. 8, 1999), United states Golf Association.", the restitution coefficient was measured. The measuring points were five points: a sweet spot and points 10 mm away from the sweet spot toward the toe-side, the heel-side, the head-upper-side, and the head-bottom-side, respectively; and the average value for the five points was obtained. It is better for the value to approach the upper limit, 0.83, regulated by the golf rules, without exceeding 0.83.

<Forming Accuracy>

By the naked eyes of a tester, forming accuracy of the first concave part of the head has been checked. If the first concave part was formed according to design values, it was evaluated as "good". Anything else (metal flew into the first concave part) was evaluated as "defective". In the wax model, the entire head was formed as one piece.

<Appearance Performance of First Flange Part>

By the naked eyes of the tester, appearance performance of the cover part of the first flange part was checked. If the thickness t2 of the cover part was small and the tip was too sharp, it was evaluated as being "defective". If the thickness t2 of the cover part was secured and the tip had a similar form to that shown in FIG. 4, it was evaluated as being "good".

Incidentally, clubs having first flange parts having various shapes were made, and it was found that the appearance of the cover part can be evaluated as being "good" or "defective", taking 1.7 mm as the criteria for the thickness of the cover part.

The test results and the like are shown in Table 1.

TABLE 1

| | embodiment 1 | comparative example 1 | embodiment 2 | embodiment 3 | comparative example 2 | comparative example 3 | comparative example 4 | comparative example 5 | comparative example 6 | comparative example 7 | embodiment 4 | embodiment 5 |
|---|---|---|---|---|---|---|---|---|---|---|---|---|
| Mass of head (g) | 246 | 248 | 245 | 249 | 246 | 248 | 246 | 249 | 247 | 246 | 247 | 249 |
| Thickness ti of first flange part* (mm) | 6.5 | 8.5 | 6.5 | 8.0 | 6.5 | 5.5 | 6.5 | 8.5 | 6.5 | 6.5 | 6.5 | 8.0 |
| Presence/absence of undercut cavity of first concave part | present | present | present | present | absent | absent | present | present | present | present | present | present |

TABLE 1-continued

| | embodiment 1 | comparative example 1 | embodiment 2 | embodiment 3 | comparative example 2 | comparative example 3 | comparative example 4 | comparative example 5 | comparative example 6 | comparative example 7 | embodiment 4 | embodiment 5 |
|---|---|---|---|---|---|---|---|---|---|---|---|---|
| Radius R1 of curvature of bottom surface of first concave part (mm) | 1.0 | 2.0 | 1.0 | 1.0 | — | — | 1.0 | 2.0 | 0.5 | 1.0 | 1.0 | 1.8 |
| Angle θ1 between rear wall surface and front wall surface of first concave part (deg.) | 10 | 10 | 20 | 10 | — | — | 30 | 30 | 10 | 5 | 28 | 10 |
| Maximum depth D1 of first concave part (mm) | 1.0 | 1.0 | 2.0 | 2.0 | — | — | 2.0 | 2.0 | 1.0 | 1.0 | 2.0 | 1.0 |
| Maximum width W1 of first concave part (mm) | 2.1 | 4.2 | 2.4 | 3.0 | — | — | 2.9 | 4.6 | 1.1 | 2.1 | 2.4 | 3.9 |
| Rebound performance (coefficient) | 0.787 | 0.786 | 0.788 | 0.788 | 0.784 | 0.783 | 0.788 | 0.787 | 0.781 | 0.784 | 0.788 | 0.787 |
| Height of center of gravity of head (mm) | 20.5 | 20.6 | 20.4 | 20.8 | 20.7 | 20.6 | 20.3 | 20.9 | 20.6 | 20.6 | 20.3 | 20.5 |
| Up-down moment of inertia Ig (g sq · cm) | 775 | 781 | 770 | 785 | 777 | 776 | 780 | 788 | 779 | 775 | 779 | 782 |
| Forming accuracy | good | good | good | good | good | good | good | good | defective | defective | good | good |
| Form of flange portion | good | good | good | good | good | good | defective | defective | good | good | good | good |

*The first flange part forms the top surface.

From the test results, it can be confirmed that the heads as Embodiments were accurately manufactured as compared with the comparative examples. Further, it was confirmed that the heads as Embodiments were significantly improved in the height of the center of gravity of the head, the rebound performance and the moment of inertia.

DESCRIPTION OF THE SIGNS

1 Iron type golf club head
2 Face portion
2*e* Peripheral edge of face portion
4 Front surface of face portion
5 Back surface of face portion
7 Flange portion
8 First flange portion
10 First concave part
11 Front wall surface
12 Rear wall surface
13 Bottom surface
c Cavity
c2 Undercut cavity

The invention claimed is:

1. An iron type golf club head having a face portion with a front surface for hitting a ball, and characterized in that the face portion is provided in its peripheral edge with a flange portion protruding backwardly of the head, a rear surface of the face portion is provided with a cavity surrounded by the flange portion, the flange portion includes a first flange part, the first flange part is provided in its inner surface side facing to the cavity with a first concave part dented toward the outside of the head so as to form an undercut cavity extending along the peripheral edge, a cross-section of the first concave part comprises a front wall surface positioned frontward of the head, a rear wall surface positioned backward of the head, and a bottom surface smoothly connecting therebetween, and the cross-section is tapered toward the bottom surface, an angle formed between the front wall surface and the rear wall surface is not less than 10 degrees and less than 30 degrees, and the bottom surface is formed of a circular arc having a radius of curvature of not less than 1 mm and less than 2 mm.

2. The iron type golf club head as set forth in claim 1, wherein the cross-section of the first concave part has a maximum width of from 2.0 mm to 4.0 mm and a maximum depth of from 1.0 mm to 2.0 mm.

3. The iron type golf club head as set forth in claim 1, wherein the first flange part can be formed at least partially in an upper side of the head.

4. The iron type golf club head as set forth in claim 1, wherein the first flange part has a thickness of from 5.5 to 8.0 mm.

5. The iron type golf club head as set forth in claim 1, wherein the flange portion includes a second flange part, the second flange part is provided in its inner surface side facing the cavity with a second concave part dented toward the outside of the head so as to form an undercut cavity extending along the peripheral edge, the cross-section of the second concave part at the deepest part includes a front wall surface positioned frontward of the head, a rear wall surface positioned backward of the head, and a bottom surface connecting therebetween, and the cross-section is tapered toward the bottom surface, an angle formed between the front wall surface and the rear wall surface of the second concave part is not less than 10 degrees and not more than 30 degrees, and the bottom surface of the second concave part has a width of not less than 2 mm.

6. The iron type golf club head as set forth in claim 5, wherein the second flange part is formed at least partially in a bottom side of the head.

7. The iron type golf club head as set forth in claim 2, wherein the first flange part can be formed at least partially in an upper side of the head.

8. The iron type golf club head as set forth in claim 2, wherein the first flange part has a thickness of from 5.5 to 8.0 mm.

9. The iron type golf club head as set forth in claim 3, wherein the first flange part has a thickness of from 5.5 to 8.0 mm.

10. The iron type golf club head as set forth in claim 2, wherein the flange portion includes a second flange part, the second flange part is provided in its inner surface side facing the cavity with a second concave part dented toward the outside of the head so as to form an undercut cavity extending along the peripheral edge, the cross-section of the second concave part at the deepest part includes a front wall surface positioned frontward of the head, a rear wall surface positioned backward of the head, and a bottom surface connecting therebetween, and the cross-section is tapered toward the bottom surface, an angle formed between the front wall surface and the rear wall surface of the second concave part is not less than 10 degrees and not more than 30 degrees, and the bottom surface of the second concave part has a width of not less than 2 mm.

11. The iron type golf club head as set forth in claim 3, wherein the flange portion includes a second flange part, the second flange part is provided in its inner surface side facing the cavity with a second concave part dented toward the outside of the head so as to form an undercut cavity extending along the peripheral edge, the cross-section of the second concave part at the deepest part includes a front wall surface positioned frontward of the head, a rear wall surface positioned backward of the head, and a bottom surface connecting therebetween, and the cross-section is tapered toward the bottom surface, an angle formed between the front wall surface and the rear wall surface of the second concave part is not less than 10 degrees and not more than 30 degrees, and the bottom surface of the second concave part has a width of not less than 2 mm.

12. The iron type golf club head as set forth in claim 4, wherein the flange portion includes a second flange part, the second flange part is provided in its inner surface side facing the cavity with a second concave part dented toward the outside of the head so as to form an undercut cavity extending along the peripheral edge, the cross-section of the second concave part at the deepest part includes a front wall surface positioned frontward of the head, a rear wall surface positioned backward of the head, and a bottom surface connecting therebetween, and the cross-section is tapered toward the bottom surface, an angle formed between the front wall surface and the rear wall surface of the second concave part is not less than 10 degrees and not more than 30 degrees, and the bottom surface of the second concave part has a width of not less than 2 mm.

* * * * *